US005865528A

United States Patent [19]

Compton et al.

[11] Patent Number: 5,865,528

[45] Date of Patent: Feb. 2, 1999

[54] INDIRECT LIGHT FIXTURE

[75] Inventors: Frederick A. Compton, Nassau Bay, Tex.; Jeffrey L. Brown, Ann Arbor, Mich.

[73] Assignee: Precision Architectural Lighting, Houston, Tex.

[21] Appl. No.: 816,358

[22] Filed: Mar. 13, 1997

[51] Int. Cl.[6] ..... F21V 7/00; F21K 00/00

[52] U.S. Cl. ..... 362/300; 362/260; 362/223; 362/299; 362/328; 362/339; 362/291; 362/224; 362/225; 362/18; 362/147

[58] Field of Search ..... 362/260, 223, 362/299, 328, 339, 291, 224, 225, 18, 147, 300

[56] References Cited

U.S. PATENT DOCUMENTS

| | | | |
|---|---|---|---|
| D. 311,596 | 10/1990 | Herst et al. | 26/85 D |
| D. 311,967 | 11/1990 | Herst et al. | 26/85 D |
| 2,675,466 | 4/1954 | Baker | 362/299 |
| 3,851,164 | 11/1974 | Intrator | 362/18 X |
| 4,186,433 | 1/1980 | Baldwin | 362/300 |
| 4,390,930 | 6/1983 | Herst et al. | 362/224 |
| 4,450,513 | 5/1984 | Guggemos | 362/299 |
| 4,644,454 | 2/1987 | Herst et al. | 362/224 |
| 4,660,131 | 4/1987 | Herst et al. | 362/223 |
| 4,667,275 | 5/1987 | Herst et al. | 362/223 |
| 4,698,734 | 10/1987 | Ngai | 362/225 |
| 4,706,170 | 11/1987 | Herst et al. | 362/217 |
| 4,760,505 | 7/1988 | Cole, Jr. | 362/225 |
| 4,933,821 | 6/1990 | Anderson | 362/328 |
| 4,939,627 | 7/1990 | Herst et al. | 362/299 |
| 4,974,137 | 11/1990 | Evans, Jr. et al. | 362/300 |
| 4,975,812 | 12/1990 | Cole, Jr. | 362/225 |
| 5,051,878 | 9/1991 | Ngai | 362/299 |
| 5,192,128 | 3/1993 | Ngai | 362/297 |
| 5,217,301 | 6/1993 | Munz et al. | 362/394 |
| 5,414,606 | 5/1995 | Weingartner | 362/328 |
| 5,416,684 | 5/1995 | Pearce | 362/340 |
| 5,530,628 | 6/1996 | Ngai | 362/33 |
| 5,636,915 | 6/1997 | Cassarly et al. | 362/32 |

FOREIGN PATENT DOCUMENTS 1238863 9/1962 Germany .

OTHER PUBLICATIONS

ANSI/IESNA RP 1–1993;*Offices with Visual Display Terminals (VDT Schrns)*; (pp. 34–14).

Peerless; 9×3 *Rounded Lightscreen Indirect*; (undated) (4 p.).

Ledalite; *Perfform System Guide*; (undated) (1 p.).

LiteControl; *Classica*; (undated) (3 p.).

Rolux; *Lam Fluorescent Indirect*; Series RO–1–94; (8 p.).

Peerless Lighting Corporation (1986) ; Peerless Lighting/6" Round; *Other Softshine Optical Systems*; (3 p.).

*Primary Examiner*—Ira S. Lazarus
*Assistant Examiner*—David Lee
*Attorney, Agent, or Firm*—Conley, Rose & Tayon, P.C.

[57] ABSTRACT

The present invention comprises a light fixture including a housing, a light source, means to secure a light source to the housing, a lens and a reflector. The reflector and lens are positioned so as to direct light from the light source onto an unlit side of the housing.

The light fixture is normally suspended from the ceiling or attached to a wall. A greater portion of the light from the light source is reflected off the ceiling or wall, whereas a smaller portion of the light from the light source is reflected off the reflector and onto the housing. After the smaller portion is reflected off the housing, the smaller portion and the larger portion are traveling in generally the same direction, thereby reducing the contrast between the housing and the ceiling or wall.

The present fixture housing is very shallow, preferably less than about 3" deep. It includes one or more side rails, with each side rail being utilized to reflect the light from the light source onto the housing with a first reflector and to alter other diffuse lighting characteristics with a lens, perforated metal, or a second reflector.

27 Claims, 5 Drawing Sheets

INDIRECT LIGHT FIXTURE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to light fixtures, and more particularly relates to indirect light fixtures. Still more particularly, the present invention relates to an indirect light fixture in which a portion of the light is directed toward the underside of the fixture housing.

2. Description of the Related Art

Ever since the invention by Thomas Edison of the light bulb in 1879 and the subsequent expiration of the Edison patent in 1894, people have been searching for better electric lighting. One step forward was the invention of the fluorescent lamp. The fluorescent lamp introduced a light source that radiated significantly less heat and could be operated at a lower cost than the before known incandescent light bulbs. Fluorescent lamps are the prevalent light source in office and educational environments today.

However, many types of lighting systems with fluorescent lamps have been identified as causing excessive glare in the normal viewing range. With the advent of the computer monitor screen, or video display terminal (VDT), the problem of glare reflected in the VDT screen has also become an issue and is a common complaint in today's business and educational environment. Most VDT screens are adjustable and have a surface that reflects the surrounding walls and ceiling. The glare is created by the background brightness contrast, seen as distracting and disabling patches on the screen.

In response to the problem of excessive contrast glare from direct luminaires, indirect lighting has been used extensively in VDT work spaces. For some time, indirect luminaires have been recognized as providing more comfortable lighting in areas where glare can be a problem. Specifically, these products are able to provide uniform low glare ambient illumination by shielding the lamp from direct view, and directing the fixture output towards room surfaces, usually the ceiling and upper walls, creating a larger and less intense emanation of reflected brightness onto work surfaces. As its use has become more prevalent, several disadvantages have been associated with indirect lighting, in spite of its inherent benefits. Although it provides a well-lighted environment, indirect lighting often gives the occupants the perception they are working in a gloomy space, commonly known as the cloudy day effect. The absence of a visual light source creates this impression of a flat and dull room atmosphere. Attempts to alleviate this effect have included product designs with side lenses and other light transmitting techniques to stimulate visual interest.

This approach is a partial solution at best. Because areas of contrast, regardless of whether they are dark or light, are distracting when reflected in a VDT screen, the dark spots caused by the housing of an indirect lighting luminaire silhouetted against the light-reflecting surface are just as undesirable as direct glare. Low ceilings and suspension of fixtures close to the ceiling only serve to exacerbate this effect by making the contrast greater. Prior art fails to address this design deficiency.

An indirect lighting fixture that is suitable for low ceiling applications while providing a comfortable visible source of brightness and reduced contrast would provide a unique solution to the problems associated with prior art luminaires.

The prior art fails to solve the problem of providing a low contrast indirect light fixture.

The prior art also fails to solve the problem of utilizing a shallow housing while simultaneously providing the reduced contrast and low glare benefits of indirect lighting.

SUMMARY OF THE INVENTION

The present invention solves the problems of providing an indirect luminaire that minimizes contrast between the fixture housing and the surrounding ceiling and walls and is suitable for use in low ceiling working environments, while simultaneously providing the benefits of indirect lighting.

A preferred embodiment of the present invention comprises a light fixture including a housing, means to secure a light source to the housing, a refracting lens and a reflector. The refracting lens directs light onto the reflector, which is positioned so as to reflect light from the light source onto an otherwise unlit side of the housing.

The light fixture is normally suspended from the ceiling or attached to a wall. A greater portion of the light from the light source is reflected off the ceiling or wall, whereas a smaller portion of the light from the light source is reflected off the reflector and onto the housing. After the smaller portion is reflected off the housing, the smaller portion and the larger portion are traveling in generally the same direction, thereby reducing the contrast between the housing and the ceiling or wall.

The luminaire of the present invention employs standard linear fluorescent lamps, although other light sources may be utilized. One or more lamps are positioned above a first horizontal reflector at a specified lateral distance from a first inclined reflector. The space between the first horizontal and inclined reflectors provides an aperture that allows a small amount of light to travel below the plane of the first horizontal reflector. The lamps are positioned such that they are not visible through the aperture from below. Inserted in the aperture is a clear linear prismatic lens. The prismatic elements of the lens are constructed such that most of the incident light on the lens will be directed (refracted) onto second, lower reflectors. The second reflectors are angled such that incident light on them is directed towards the underside of the fixture housing, providing a visually appealing glow and reducing contrast between the underside of the fixture housing and the lighted ceiling above.

The present fixture housing is very shallow, preferably less than about 3" deep. It includes one or more side rails, with each side rail being utilized to reflect the light from the light source onto the housing with a first reflector and to alter other diffuse lighting characteristics with a lens, perforated metal, or a second reflector.

It is therefore an object of the present invention to provide an indirect luminaire, which minimizes the contrast between the lighted ceiling and the underside of the luminaire housing.

It is another object of the present invention to indirectly light the underside of the luminaire housing through the use of refracting lens and reflectors positioned below the lens.

Yet another object of the invention is to provide an aesthetically appealing shallow housing, suitable for use in low ceiling applications.

Still another object of the present invention, is to provide efficient uniform indirect lighting while providing a visible element of source brightness.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Figure 1:
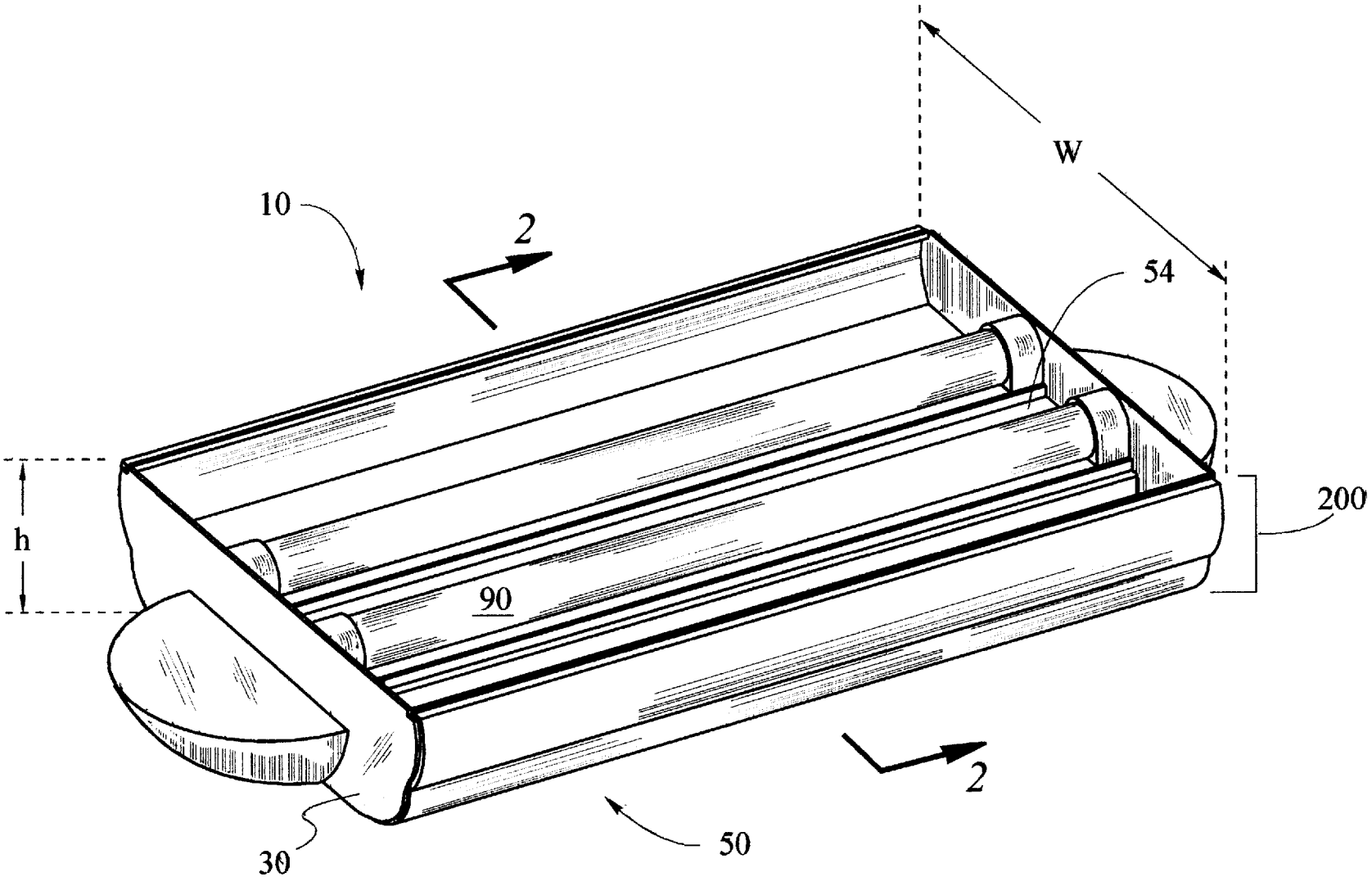
FIG. 1 is an isometric view of a pendant embodiment of an indirect light fixture constructed in accordance with the present invention.

FIG. 1 shows an isometric view of a preferred embodiment of the present invention comprising a pendant or suspended mount light fixture 10. Pendant fixture 10 includes housing 50, lamps 90, side rails 200, socket plate 54, and a set of end plates 30. Side rails 200 and, housing 50, are affixed to end plates 30 so as to form a unitary piece. The dimension of the housing is preferably, but not necessarily, approximately 3" high×9" wide. As can be seen, its width W is substantially greater than its height h, allowing its use in low ceilinged applications. Housing 10 may be of any appropriate length, and in a preferred embodiment has a ratio of length to width that is somewhat greater than that shown in FIG. 1.

The pendant embodiment shown in FIG. 1 is preferably hung so that it is a minimum of about 12" from the ceiling. It is hung by a suspension assembly (not shown), such as are known in the art. An alternative embodiment is a wall mounted configuration, anchored flush against a wall, which is described in detail below.

Those in the industry define indirect lighting as light that originates at an angle above horizontal. Similarly, direct lighting is defined as light that originates at an angle below horizontal. However, this invention will work equally well when oriented at any angle. The use of directional or relative terminology herein, such as "indirect" and "direct", and "under" and "downward," is merely to conform to usage common in the industry and to aid in explanation. It should not be inferred that this invention does not operate equally well at any other angle or that this language limits the scope of the invention in any way.

Figure 2:
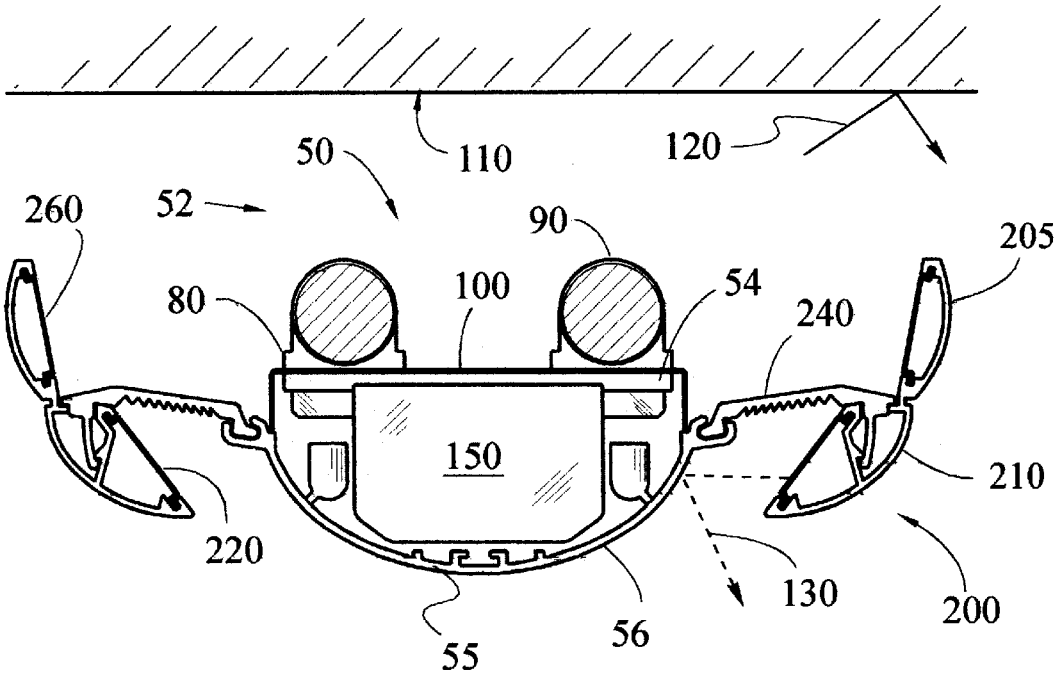
FIG. 2 is a cross-sectional view taken along lines 2—2 of FIG. 1.

Referring now to FIG. 2, a cross-sectional view of the embodiment of FIG. 1 is shown, including housing 50, lamps 90, side rails 200, socket plate 54, and a lower, channel shaped bed 55 having an exterior surface 56. Housing 50 also includes a ballast 150, such as are known in the art. Housing 50 is provided on an illuminant side 52 with lamp holders 80. Lamp holders 80 are anchored to socket plate 54 in a conventional manner. Lamps 90 are received in lamp holders 80 and are envisioned as being linear fluorescent lamps, although other light sources may be used.

As explained above, the invention of FIG. 2 is suspended some distance below a ceiling 110 or a similar room surface. As lamps 90 radiate light, light reflects off ceiling 110 in the manner illustrated at 120, thereby providing adequate and aesthetically pleasing ambient illumination. Overall illumination is increased by usage of a high-reflectant specular aluminum center reflector 100 placed over socket plate 54. This reflector 100 reflects downward light emitted from lamps 90, thereby increasing the amount of light that is reflected off the ceiling 110 or other room surface. Although FIG. 2 shows two lamps 90, it will be understood that the number of lamps is not critical to the invention. Three or more lamps can be utilized or, alternatively, a single lamp can be used if preferred.

The precise shape of housing 50 is not critical, although the present invention's slim profile is advantageous. Nonetheless, for maximum benefit of the present invention, the housing should be interposed between the light source 90 and a potential viewer and/or computer screen (not shown). This eliminates the glare associated with direct light from a bare lamp.

The pendant embodiment shown in FIG. 2 includes two side rails, indicated generally as 200. Each side rail 200 includes an upper portion 205 and a lower portion 210. Side rails 200 preferably comprise thin extruded aluminum. The lower portion 210 of each side rail 200 includes a reflector 220. Reflector 220 may be of any reflective or specular surface, but is preferably white enamel aluminum. In addition, in the embodiment shown in FIG. 2, upper portions 205 each include a high reflectance specular aluminum side reflector 260. Other light reflective surfaces may of course be used.

Figure 2A:
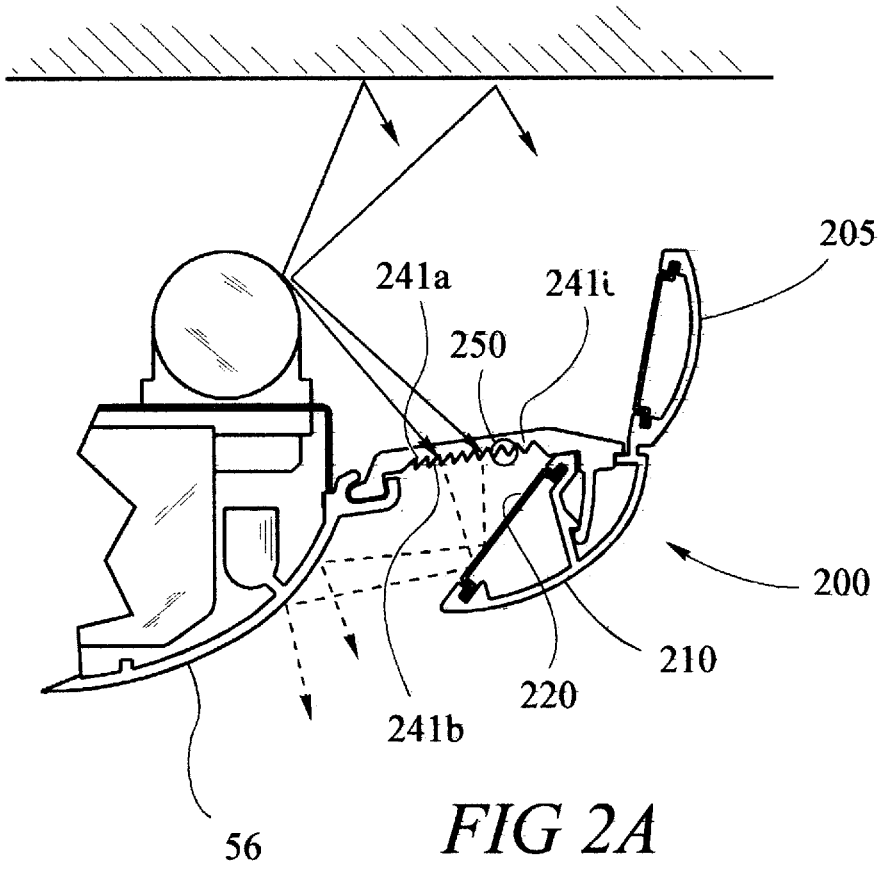
FIG. 2A is an enlarged view one side portion of the light fixture of FIG. 1.
Figure 2B:
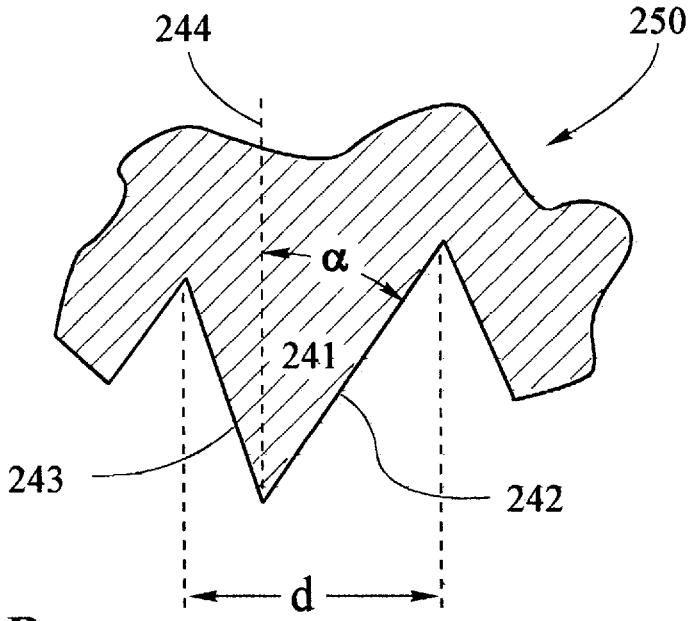
FIG. 2B is a further enlarged view of the element indicated by 250 in FIG. 2A.

The preferred embodiment also includes a lens 240 positioned between light source 90 and reflector 220. Lens 240 serves to further diffuse the light passing through it from light source 90 and is constructed such that is refracts a maximum amount of light onto reflector 220. A clear acrylic linear prismatic lens is suitable for this purpose. Referring to FIGS. 2A–B, it can be seen that lens 240 preferably comprises a plurality of linear prisms 241*a–i*. A preferred construction of one prism is best illustrated in FIG. 2B, which shows an enlargement of the item identified at numeral 250 in FIG. 2A. Specifically, each prism 241 has a refracting face 242 and a back face 243, and defines a peak angle $\alpha$. The peak angle $\alpha$ is the angle between the refracting face 242 and a vertical line 244. The peal-to-peak distance d is the horizontal distance one peak and an adjacent peak. Proceeding from left to right as drawn in FIG. 2A, each linear prism 241*a–i* has a peak angle $\alpha$ that is generally slightly smaller than the peak angle of the preceding prism. Similarly, the distance between adjacent peaks generally increases incrementally with distance from the center of the fixture. Specific values for each $\alpha$. and d are given for each prism in Example I below. The values given in Example I are intended to be illustrative only, and are not limiting. Construction of lens 240 in accordance with the foregoing description is not necessary to operation of the invention, but it is preferred, as it increases the portion of light that is refracted by the lens onto the underside 56 of housing 50. A most preferred embodiment of lens 240 is one in which the peak angles α and peak-to-peak distances d are calculated for each light fixture configuration so as to optimize refraction of the light striking lens 240 onto exterior surface 56. Some factors affecting this calculation include refractive index of the lens material and the relative positions of lamp 90, lens 240 and reflector 220.

Example I

| Linear prism | Peak Angle α | Peak-to-Peak Distance d (inches) |
|---|---|---|
| 241a | 52° | .082 |
| 241b | 49° | .080 |
| 241c | 47° | .081 |
| 241d | 45° | .081 |
| 241e | 43° | .084 |
| 241f | 42° | .089 |
| 241g | 41° | .095 |
| 241h | 41° | .104 |
| 241i | 43° | .116 |

In operation, both direct and indirect light from fluorescent lamps 90 strikes lens 240. Due to the transparent or translucent nature of lens 240, the light passes through the lens and strikes reflector 220, which reflects a portion of it 130 onto the exterior surface 56 of bed 55, thereby subtly illuminating it as shown in FIGS. 2 and 2A. As a result, the light portion 130 reflected off bed 55 travels toward the viewer (not shown), in a generally downward direction. Because exterior surface 56 is convex, light reflecting off it is scattered. In addition, in both the pendant and wall mounted embodiments, the light 120 reflected from the wall or ceiling also ultimately ends up traveling toward the viewer. Therefore, both the portion of the light 120 reflected directly off the room surface 110 and the portion of light 130 reflected off the exterior 56 of the housing 50 travel in generally the same direction (e.g. generally downward as shown).

The illumination of the dark side of housing 50 in this manner reduces the contrast that would otherwise be visible between the exterior 56 of housing 50 and the illuminated room surface 110. It is the perception of both portions of light 120, 130 by the viewer that reduces the contrast between the housing and the light reflected off the ceiling or wall. Such a reduction of contrast reduces the variations in reflective glare associated with prior art indirect light fixtures. It also provides visual interest to the lighting system as a whole.

Only a small percentage of the total light, on the order of 1–20%, and preferably approximately 3%, is transmitted through lens 240 and illuminates the exterior 56 of housing 50. It is critical that reflector 220 direct most of the light striking it so as to illuminate the exterior 56 surface of the housing 50.

While side rails 200 are shown attached to housing 50 by means of end plates 30 in FIG. 1, it is envisioned that some other place of attachment could be employed. Indeed, side rails 200 or reflectors 220 could be attached to the ceiling, a wall, the suspension assembly, or other suitable support device, although none of these are as practical, visually appealing or elegant as the preferred configuration shown.

Figure 3:
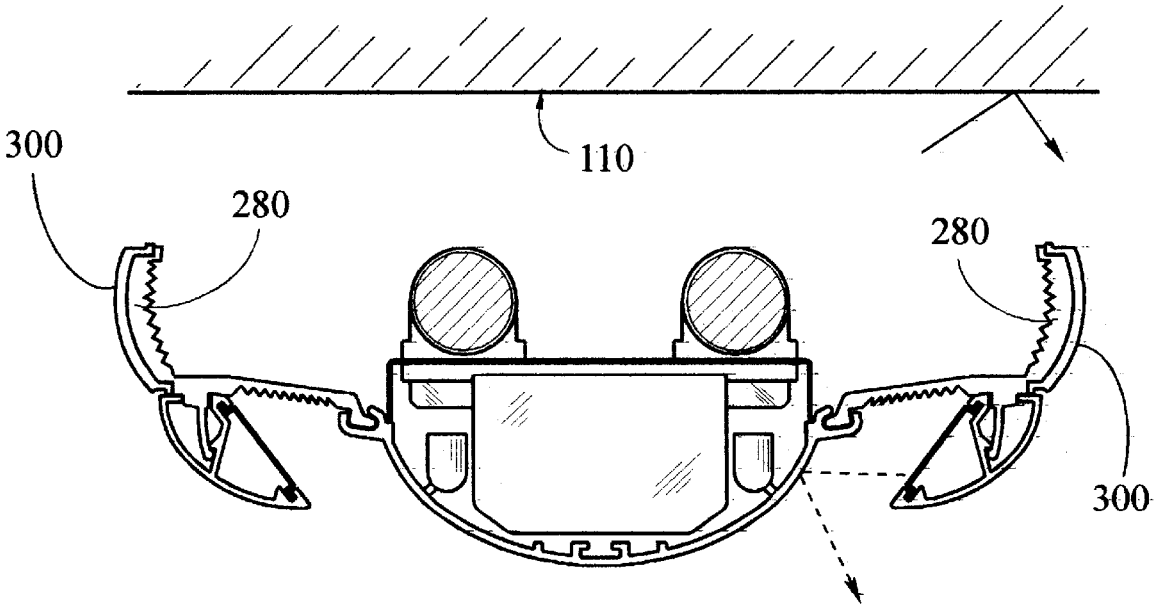
FIG. 3 is a cross-section view similar to that shown in FIG. 2, but showing a perforated metal upper side rail.

In contrast to the embodiment shown in FIG. 2, FIG. 3 shows the upper portion of side rail 200 consisting of perforated metal 300 backed with a second linear prismatic lens 280. The perforated metal side rail 300 preferably comprises a thin metal sheet including multiple holes, punctures, or perforations. Second lens 280 is preferably, but not necessarily, formed integrally with lens 220 for ease of manufacturing and assembly. Second lens 280 also preferably includes a plurality of linear prismatic lenses, which may be regular, or irregular as described above with respect to lens 240.

Figure 4:
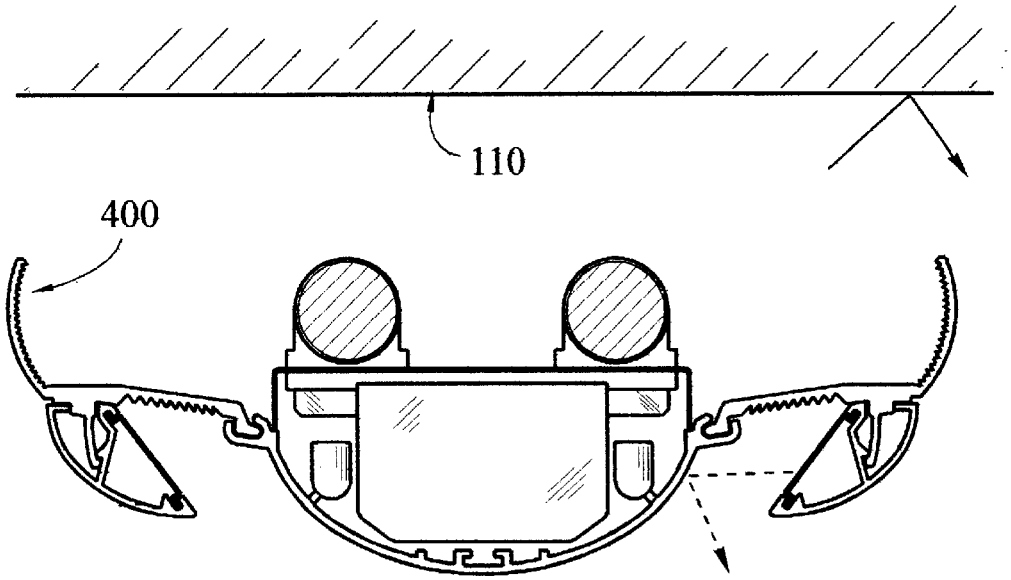
FIG. 4 is a cross-section view similar to that shown in FIG. 2, but showing a lens upper side rail.

FIG. 4 shows the upper portion of side rail 200 comprising a translucent lens 400. It will be understood that each of these variations allows transmission and reflection of varying proportions of the light striking the upper portions of the side rails. Variations in the construction of side rails 200 allow a manufacturer to significantly alter the lighting characteristics of the present invention without great expense and without making the housing deeper. These variations affect the appearance of the light fixture, but have a negligible effect on the novel features of the invention.

Figure 6:
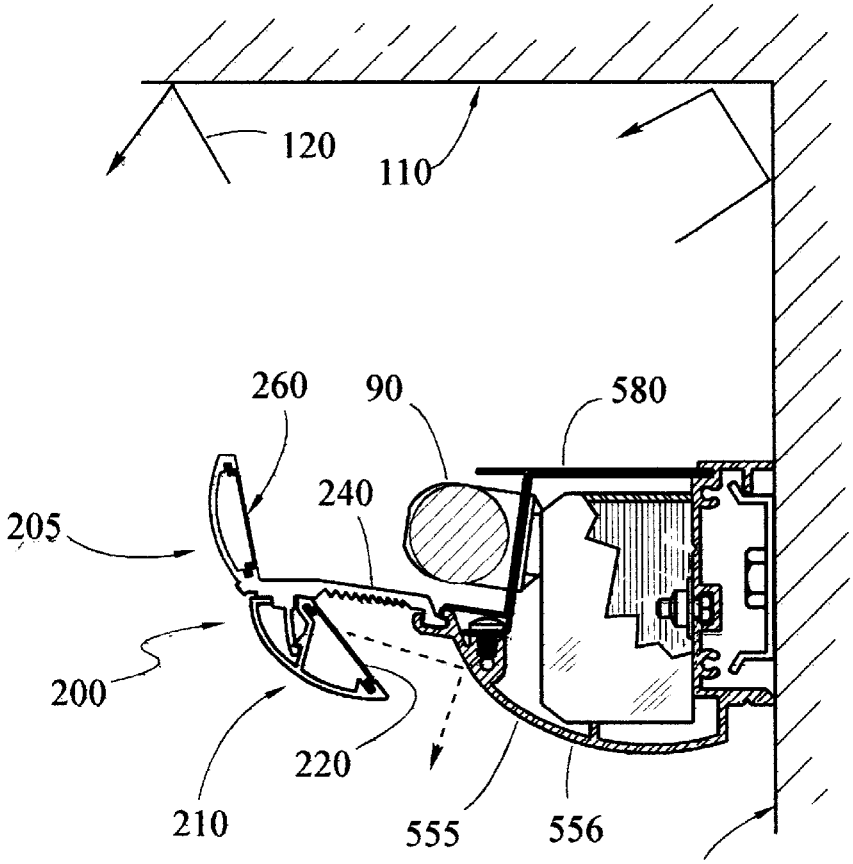
FIG. 6 is a cross-sectional view of a wall-mounted embodiment of an indirect light fixture constructed in accordance with the present invention.
Figure 5:
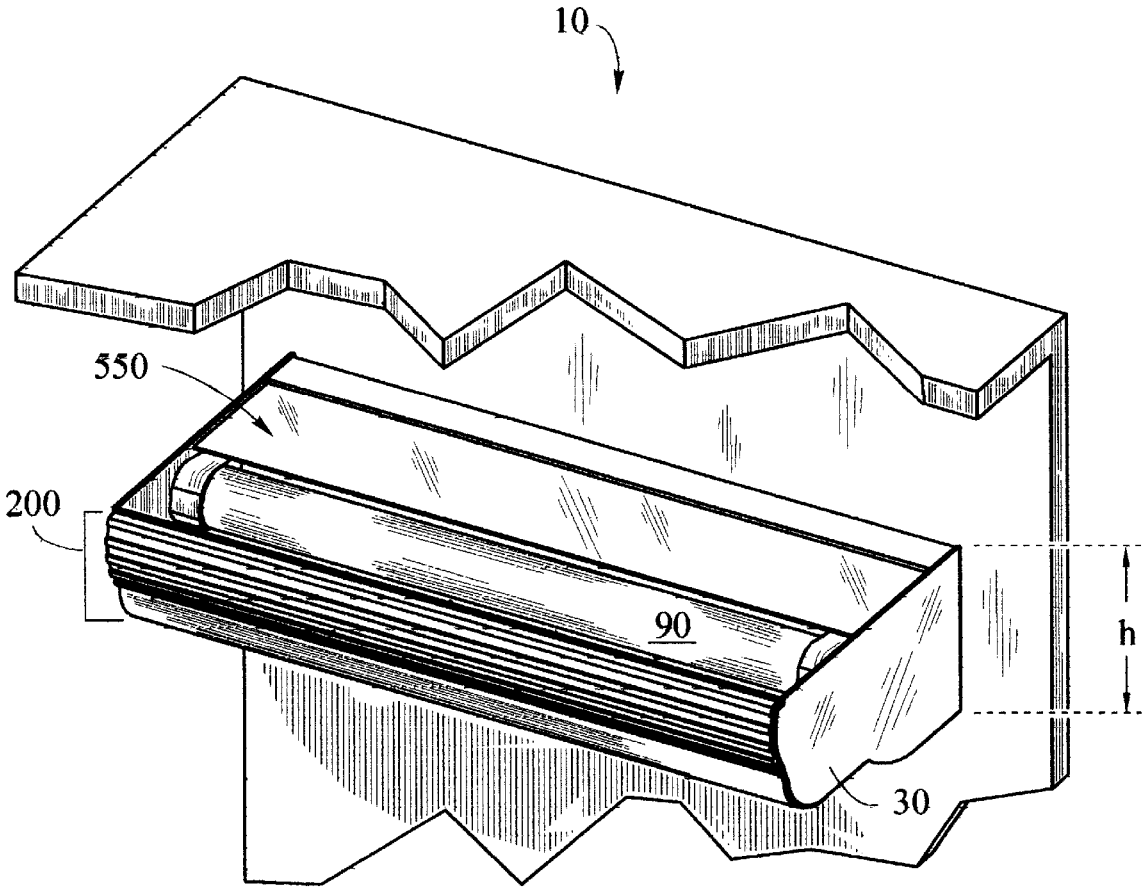
FIG. 5 is an isometric view of a wall-mounted embodiment of an indirect light fixture constructed in accordance with the present invention.

Referring now to FIGS. 5 and 6, a wall mounted embodiment of the present invention is shown, in which components corresponding to those of FIG. 2 have been labeled correspondingly. The wall mounted embodiment of the present light fixture comprises a housing 550, lamps 90, one side rail 200 and set of end plates 30. The wall mounted housing 550 includes a channel-shaped bed 555 having an exterior surface 556 and includes a ballast cover 580 designed to further help reduce contrast. As described above, the side rail 200 is supported by end plates 30. Once again, the height h of the housing is preferably on the order of 3" or less.

As described above, side rail 200 includes upper and lower portions 205, 210, respectively, which support reflectors 260 and 220, respectively. A lens 240 extends between channel-shaped bed 555 and side rail 200. Wall mount housing 555 is anchored flush against a wall 115, and is preferably located at least about 12" from the ceiling 110 for maximum benefit.

In a similar manner to the embodiment shown in FIG. 2, light from lamp 90 passes through lens 240 to strike reflector 220. Reflector 220 illuminates the exterior 556 of the housing 555 and reduces the contrast between the dark side of the housing 555 and the ambient illumination 120. As with the pendant embodiment described above, alternative wall-mounted embodiments can also be employed, with the upper portion 205 of side wall 200 being replaced with lens-backed perforated metal, a lens alone, or the like. The choice of reflector 260, perforated metal, or a lens depends on the lighting characteristics desired by the user. By selecting a different upper portion 205 of side rail 200, different widespread illumination characteristics are achieved.

Although the present invention has been described with reference to preferred embodiments, those skilled in the art will recognize that changes may be made in the form and detail without departing from the spirit and scope of the invention.

What is claimed is:

1. A light fixture comprising:

a housing including a first side and a second side;

a light source secured to said housing on said first side;

a reflector support proximate to said housing capable of reflecting a first portion of light from said light source onto said second side of said housing; and a lens through which light from the light source passes before striking said reflector;

said housing being configured such that, absent said reflector, light from said light source would not be incident on said second side.

2. The light fixture of claim 1 wherein said reflector is attached to said housing.

3. The light fixture of claim 1, wherein said housing is no more than 3" deep.

4. The light fixture of claim 1, wherein said lens includes a plurality of prisms.

5. The light fixture of claim 4, wherein each of said prisms has a peak angle and a peak-to-peak distance and said peak angles generally decrease with distance from the light source.

6. The light fixture of claim 5, wherein said peak-to-peak distances generally increase with distance from the light source.

7. The light fixture of claim 1, wherein said light fixture is mounted so as to reflect light off a room surface, said surface reflecting a second portion of said light from said light source, wherein said second portion of said light is larger than said first portion.

8. The light fixture of claim 7, wherein said second portion of said light after reflection, and said first portion of said light after striking said second side of said housing, travel in generally the same direction.

9. The light fixture of claim 7, wherein said first portion of said light reduces the contrast between said second housing side and said room surface reflecting said second portion of said light.

10. A lighting assembly comprising:

a base including illuminant and exterior sides;

a light source attached to said illuminant side; and at least one side rail connected to said base;

wherein a first portion of said side rail reflects light from said light source to said exterior side of said base.

11. The lighting assembly of claim 10, further comprising a first lens through which said light passes before being reflected off said first portion of said side rail.

12. The lighting assembly of claim 10, wherein said base includes a ballast.

13. The lighting assembly of claim 10, wherein said base is no more than about 3" deep.

14. The lighting assembly of claim 10, wherein said side rail includes a second portion that reflects light from said light source back toward said illuminant side of said base.

15. The light fixture of claim 10, wherein said first lens includes a plurality of linear prisms.

16. The light fixture of claim 15, wherein each of said prisms has a peak angle and a peak-to-peak distance and said peak angles generally decrease with distance from the light source.

17. The light fixture of claim 16, wherein said peak-to-peak distances generally increase with distance from the light source.

18. The lighting assembly of claim 10 wherein said side rail is positioned adjacent to said base.

19. The lighting assembly of claim 18, wherein said side rail includes a second lens through which a third portion of light from said light source passes.

20. The lighting assembly of claim 19, wherein said side rail includes a perforated metal portion.

21. The light fixture of claim 20, wherein said illuminant side of said base is highly reflective.

22. An indirect lighting system, comprising:

a light source;

a housing connected to and supporting said light source, said housing including a first side and a second side, said second side being defined such that from said light source cannot be directly incident on said second side;

a separate reflective surface adjacent said light source opposite said housing for reflecting a first portion of light;

a reflector, supported proximate to said housing, said reflector being configured to reflect a second portion of light from said light source onto said second side of said housing, said reflector being positioned such that said reflector reflects light emitted by said light source in a direction away from said reflective surface; and a lens through which light from said light source passes before striking said reflector.

23. A method of lighting a room, comprising the steps of:

(a) positioning a base having at least first and second sides adjacent to a room surface;

(b) providing light from a light source proximate to the first side of the base;

(c) reflecting a first portion of said light from the light source off said room surface;

(d) reflecting a second portion of the light from said light source to the second side of the base; and (e) refracting the second light portion prior to reflecting it onto the second side of the base.

24. The method of claim 23, wherein said light reflected off the room surface and said light reflected off the second side of the base travel in generally the same direction.

25. The method of claim 23, wherein said first portion of light reflected off the room surface is of greater intensity than said second portion of light reflected off the second side of the base.

26. The method of claim 23, wherein said light source is positioned between the first side of the base and the room surface.

27. The method of claim 23, wherein step (c) and step (d) reduce the contrast between the room surface and the second side of said base.

* * * * *